US009518568B2

(12) United States Patent
Ota et al.

(10) Patent No.: US 9,518,568 B2
(45) Date of Patent: Dec. 13, 2016

(54) SWASH PLATE TYPE VARIABLE DISPLACEMENT COMPRESSOR

(71) Applicant: KABUSHIKI KAISHA TOYOTA JIDOSHOKKI, Aichi-ken (JP)

(72) Inventors: Masaki Ota, Kariya (JP); Shinya Yamamoto, Kariya (JP); Takahiro Suzuki, Kariya (JP); Kazunari Honda, Kariya (JP); Hideharu Yamashita, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 161 days.

(21) Appl. No.: 14/602,458

(22) Filed: Jan. 22, 2015

(65) Prior Publication Data

US 2015/0211502 A1 Jul. 30, 2015

(30) Foreign Application Priority Data

Jan. 30, 2014 (JP) ..... 2014-015666

(51) Int. Cl.

| | |
|---|---|
| ***F04B 7/00*** | (2006.01) |
| ***F04B 1/20*** | (2006.01) |
| ***F04B 1/24*** | (2006.01) |
| ***F04B 1/12*** | (2006.01) |
| ***F04B 1/29*** | (2006.01) |
| ***F04B 27/18*** | (2006.01) |
| ***F04B 27/12*** | (2006.01) |
| ***F04B 27/16*** | (2006.01) |

(52) U.S. Cl.

CPC ..... *F04B 1/295* (2013.01); *F04B 1/128* (2013.01); *F04B 1/2042* (2013.01); (Continued)

(58) Field of Classification Search

CPC ..... F04B 2205/15; F04B 49/22; F04B 49/24; F04B 53/10; F04B 1/295; F04B 2027/1813; F04B 2027/1831; F04B 2027/1854; F04B 27/12; F04B 27/18; F04B 27/1804; F04B 27/1054; F04B 2027/1809; F04B 2027/185; F04C 14/24; F04C 2270/58; F04C 28/24; F04D 15/0005; F04D 15/02; F04D 27/009; F04D 27/0207

(Continued)

(56) References Cited

U.S. PATENT DOCUMENTS 6,227,812 B1 * 5/2001 Kawaguchi ..... F04B 27/1804 417/222.2
6,382,926 B2 * 5/2002 Ota ..... F04B 27/1804 417/222.2

(Continued)

FOREIGN PATENT DOCUMENTS

JP 01-190972 8/1989
JP 11-280660 10/1999

(Continued)

*Primary Examiner* — Dominick L Plakkoottam
(74) *Attorney, Agent, or Firm* — Greenblum & Bernstein, P.L.C.

(57) ABSTRACT

An inclination angle of a swash plate of a swash plate type variable displacement compressor is rapidly changed to the maximum when electric current is supplied to an electromagnetic solenoid and therefore the compressor is operated at the maximum displacement. When a second valve body is opened, a first valve body is closed; when the second valve body is closed, a valve opening of the first valve body is controlled. Under the circumstance that electric current is supplied to the electromagnetic solenoid and an instruction for operating the compressor at the maximum displacement is issued, when the first valve body is closed, the second valve body is opened. In addition to supply of refrigerant gas from a discharge chamber to a control pressure chamber through a first supply passage, refrigerant gas is supplied from the discharge chamber to the control pressure chamber through a second supply passage.

6 Claims, 6 Drawing Sheets

(52) U.S. Cl.
CPC ..... *F04B 1/2078* (2013.01); *F04B 1/24* (2013.01); *F04B 7/0076* (2013.01); *F04B 27/12* (2013.01); *F04B 27/16* (2013.01); *F04B 27/18* (2013.01); *F04B 27/1804* (2013.01); *F04B 2027/1809* (2013.01); *F04B 2027/1827* (2013.01)

(58) Field of Classification Search
USPC ..... 417/222.1, 222.2, 269, 270; 62/498
See application file for complete search history.

(56) References Cited

U.S. PATENT DOCUMENTS

| | | | | |
|---|---|---|---|---|
| 9,010,138 | B2 * | 4/2015 | Yoshida | F04B 11/0091 417/213 |
| 9,228,576 | B2 * | 1/2016 | Yamamoto | F04B 27/18 |
| 9,316,217 | B2 * | 4/2016 | Yamamoto | F04B 27/1804 |
| 2005/0287014 | A1 * | 12/2005 | Umemura | F04B 27/1804 417/222.1 |
| 2009/0220356 | A1 * | 9/2009 | Yamamoto | F04B 27/1804 417/222.1 |
| 2009/0269216 | A1 * | 10/2009 | Ota | F04B 27/1804 417/222.1 |
| 2012/0251343 | A1 * | 10/2012 | Taguchi | F04B 27/1804 417/222.2 |
| 2013/0126017 | A1 * | 5/2013 | Ota | F04B 27/1804 137/487.5 |
| 2015/0044065 | A1 | 2/2015 | Ota et al. | |
| 2015/0044067 | A1 | 2/2015 | Ota et al. | |

FOREIGN PATENT DOCUMENTS

| | | |
|---|---|---|
| JP | 2011-149377 | 8/2011 |
| JP | 2013-108364 | 6/2013 |

* cited by examiner

SWASH PLATE TYPE VARIABLE DISPLACEMENT COMPRESSOR

BACKGROUND OF THE INVENTION

The present invention relates to a swash plate type variable displacement compressor in which a plurality of pistons engaged with a swash plate reciprocate with a stroke length in accordance with an inclination angle of the swash plate.

Japanese Unexamined Patent Application Publication No. 1-190972 discloses a compressor of swash plate type having a movable body that is coupled to the swash plate and allows the swash plate to change its inclination angle. The movable body is movable in the axial direction of a rotary shaft of the compressor in response to a change in pressure of control gas (refrigerant gas) introduced into a control pressure chamber formed in a housing of the compressor. The inclination angle of the swash plate is varied by the movement of the movable body in the axial direction of the rotary shaft.

Specifically, when the pressure in the control pressure chamber is increased approximately to a level corresponding to the pressure of a discharge-pressure zone of the compressor, the movable body moves in the axial direction of the rotary shaft toward one end of the rotary shaft. With such movement of the movable body to the one end of the rotary shaft, the inclination angle of the swash plate is increased. When the pressure in the control pressure is decreased approximately to a level corresponding to the pressure of a suction-pressure zone of the compressor, on the other hand, the movable body moves in the axial direction of the rotary shaft toward the other end of the rotary shaft. With such movement of the movable body to the other end of the rotary shaft, the inclination angle of the swash plate is decreased. With a decrease in the inclination angle of the swash plate, the stroke length of the pistons and hence the displacement of the compressor are decreased. With an increase in the inclination angle of the swash plate, the stroke length of the pistons and hence the displacement of the compressor are increased. The swash plate type variable displacement compressor disclosed in the above-cited publication has a displacement control valve that controls the pressure in the control pressure chamber.

In such a swash plate type variable displacement compressor, a throttle is provided in a first supply passage at a midway position thereof between the discharge-pressure zone and the control pressure chamber. Such throttle restrains the flow of the control gas supplied from the discharge-pressure zone to the control pressure chamber through the first supply passage to thereby facilitate holding of the inclination angle of the swash plate at an intermediate position between the maximum and minimum inclination angle positions. Accordingly, the operating efficiency of the compressor at an intermediate displacement is improved.

However, the provision of such throttle in the first supply passage prevents the pressure in the control pressure chamber from being increased rapidly to a level corresponding to the pressure of the discharge-pressure zone when the air-conditioning switch of a vehicle air conditioner is turned ON to supply electric current to the electromagnetic solenoid and an instruction is made by a control computer for the operation of the compressor at the maximum displacement. As a result, the inclination angle of the swash plate cannot be changed to the maximum rapidly, thus taking a long time before the operation of the compressor at the maximum displacement is started.

The present invention has been made in view of the circumstances above and is directed to providing a swash plate type variable displacement compressor that changes the inclination angle of the swash plate to the maximum rapidly when electric current it supplied to the electromagnetic solenoid and the compressor is instructed to operate at the maximum displacement.

SUMMARY OF THE INVENTION

In order to solve the above problems and in accordance with one aspect of the present invention, there is provided a swash plate type variable displacement compressor that includes a housing that includes a suction-pressure zone and a discharge-pressure zone; a rotary shaft that is rotatably supported in the housing; a swash plate that is disposed in the housing and is driven by the rotary shaft to rotate; a plurality of pistons that is engaged with the swash plate; a movable body coupled to the swash plate and adapted to change an inclination angle of the swash plate; a control pressure chamber that is defined by the movable body and adapted to move the movable body in an axial direction of the rotary shaft when control gas drawn into the control pressure chamber changes pressure of the control pressure chamber; and a displacement control mechanism that controls pressure of the control pressure chamber. The pistons are movable reciprocally with a stroke length in accordance with the inclination angle of the swash plate. A first supply passage and a second supply passage extend from the discharge-pressure zone to the control pressure chamber and are partially parallel-connected between the discharge-pressure zone and the control pressure chamber. A bleed passage extends from the control pressure chamber to the suction-pressure zone. The displacement control mechanism includes a throttle that is provided in a first supply passage, a first valve body that controls an opening of the bleed passage, a pressure-sensitive mechanism that senses pressure in the suction-pressure zone to be expanded or contracted in a moving direction of the first valve body to thereby control a valve opening of the first valve body, an electromagnetic solenoid, a drive force transmitting part that changes setting of the pressure-sensitive mechanism when electric current is supplied to the electromagnetic solenoid, and a second valve body that opens or closes the second supply passage by the drive force transmitting part. When the second valve body is opened, the first valve body is closed, and when the second valve body is closed, valve opening of the first valve body is controlled.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the embodiments together with the accompanying drawings in which:

DETAILED DESCRIPTION OF THE PREFERRED EMBODIMENTS

An embodiment of the swash plate type variable displacement compressor according to the present invention will now be described with reference to FIGS. 1 to 5. The compressor is used for an air-conditioning system in a vehicle.

Figure 1:
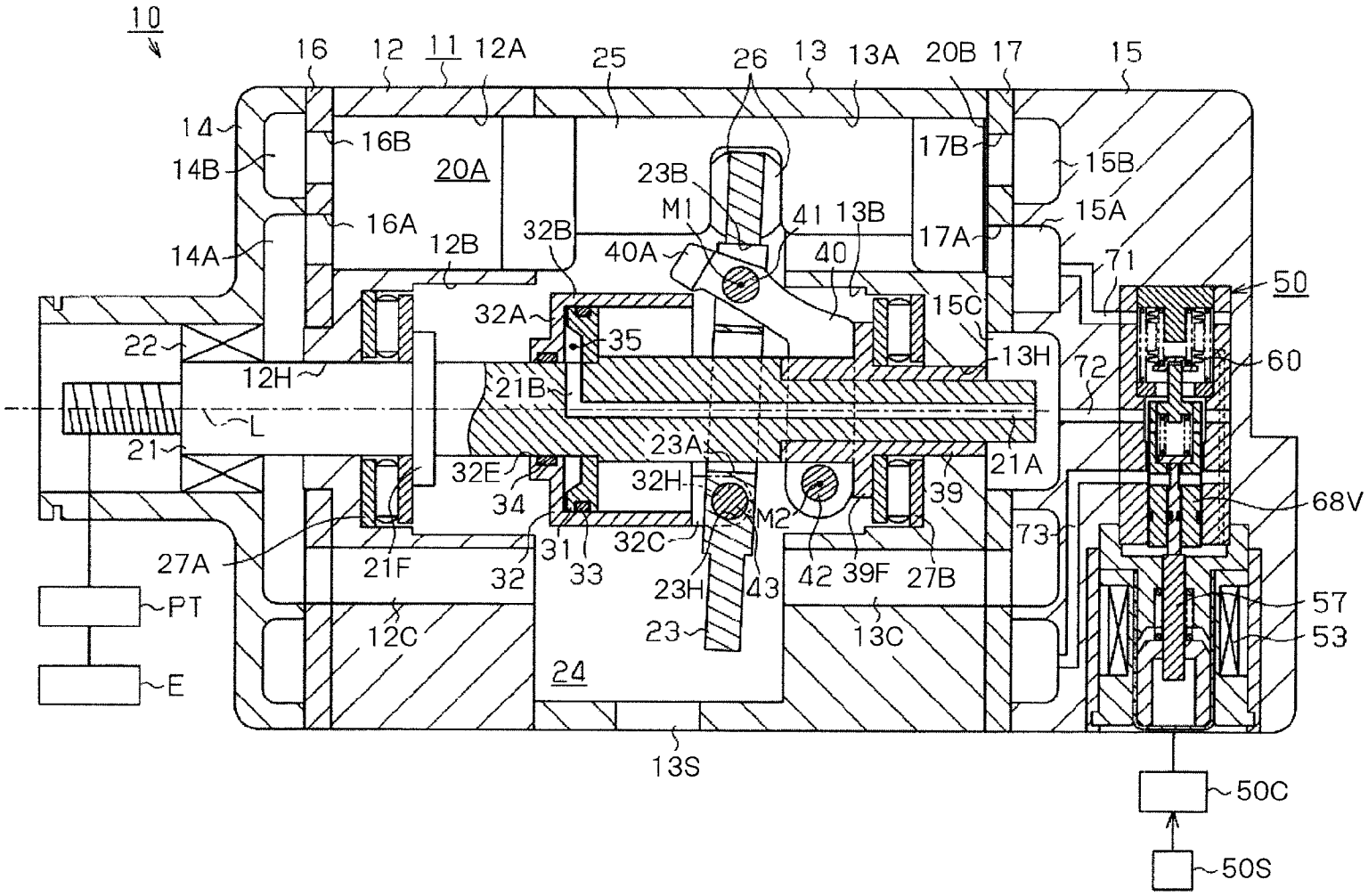
FIG. 1 is a longitudinal sectional view of a swash plate type variable displacement compressor having a swash plate according to a first embodiment of the present invention.

Referring to FIG. 1, the swash plate type variable displacement compressor is designated by numeral 10 and includes a housing 11. The housing 11 includes a first cylinder block 12 and a second cylinder block 13 that are connected to each other, a front housing 14 that is connected to the front side (one side) of the first cylinder block 12 of the compressor, and a rear housing 15 that is connected to the rear side (the other side) of the second cylinder block 13 of the compressor.

A first valve and port forming body 16 is interposed between the front housing 14 and the first cylinder block 12. A second valve and port forming body 17 is interposed between the rear housing 15 and the second cylinder block 13.

A suction chamber 14A and a discharge chamber 14B are defined individually between the front housing 14 and the first valve and port forming body 16. The discharge chamber 14B is disposed radially outward of the suction chamber 14A. A suction chamber 15A and a discharge chamber 15B are formed individually between the rear housing 15 and the second valve and port forming body 17. The rear housing 15 further has therein a pressure regulation chamber 15C. The pressure regulation chamber 15C is disposed at the center of the rear housing 15, the suction chamber 15A is disposed further radially outward of the pressure regulation chamber 15C, and the discharge chamber 15B is disposed radially outward of the suction chamber 15A. The discharge chamber 14B and the discharge chamber 15B are connected to each other through a discharge passage that is connected to an external refrigeration circuit (not shown). The discharge chambers 14B, 15B form a part of the discharge-pressure zone of the compressor 10.

The first valve and port forming body 16 has therethrough a suction port 16A that is communicable with the suction chamber 14A and a discharge port 16B that is communicable with the discharge chamber 14B. The second valve and port forming body 17 has therethrough a suction port 17A that is communicable with the suction chamber 15A and a discharge port 17B that is communicable with the discharge chamber 15B. Each of the suction ports 16A, 17A has a suction valve mechanism (not shown) and each of the discharge ports 16B, 17B has a discharge valve mechanism (not shown).

A rotary shaft 21 is rotatably supported in the housing 11. One end part of the rotary shaft 21 in the extending direction of a center axis L (i.e. axial direction of the rotary shaft 21), that is, a front end part of the rotary shaft 21 located in the front part (one side part) of the housing 11 is inserted in a shaft hole 12H that is formed through the first cylinder block 12. The front end of the rotary shaft 21 is located in the front housing 14. The other end part of the rotary shaft 21 in the extending direction of the center axis L, that is, a rear end part of the rotary shaft 21 located in the rear part (the other side part) of the housing 11 is inserted in a shaft hole 13H that is formed through the second cylinder block 13. The rear end of the rotary shaft 21 is located in the pressure regulation chamber 15C.

The front end part of the rotary shaft 21 is rotatably supported by the first cylinder block 12 through the shaft hole 12H and the rear end part of the rotary shaft 21 is rotatably supported by the second cylinder block 13 through the shaft hole 13H. A shaft sealing device 22 of lip seal type is interposed between the front housing 14 and the rotary shaft 21. A vehicle engine E as an external drive source is operatively coupled to the front end of the rotary shaft 21 through a power transmission mechanism PT. The power transmission mechanism PT according to the present embodiment is a continuous power-transmitting mechanism of clutchless type (e.g. an assembly of a belt and a pulley).

In the housing 11, a crank chamber 24 is formed between the first cylinder block 12 and the second cylinder block 13. The crank chamber 24 accommodates a swash plate 23 that is driven by the rotary shaft 21 to rotate and is tiltable relative to the axial direction of the rotary shaft 21. The swash plate 23 has an insertion hole 23A through which the rotary shaft 21 is inserted. The swash plate 23 is mounted on the rotary shaft 21 that is inserted in the insertion hole 23A.

The first cylinder block 12 has therein a plurality of first cylinder bores 12A (only one first cylinder bore being shown in FIG. 1) formed around the rotary shaft 21 and extending in the axial direction of the first cylinder block 12. The first cylinder bores 12A are arranged around the rotary shaft 21 (FIG. 1 shows only one first cylinder bore 12A). Each first cylinder bore 12A is communicable with the suction chamber 14A through the suction port 16A and also communicates with the discharge chamber 14B through the discharge port 16B. The second cylinder block 13 has therethrough a plurality of second cylinder bores 13A (only one second cylinder bore being shown in FIG. 1) formed therethrough in the axial direction of the second cylinder block 13. The second cylinder bores 13A are arranged around the rotary shaft 21 (FIG. 1 shows only one second cylinder bore 13A). Each second cylinder bore 13A is communicable with the suction chamber 15A through the suction port 17A and also communicable with the discharge chamber 15B through the discharge port 17B. The first cylinder bore 12A and the second cylinder bores 13A are disposed so as to form a plurality of pairs of first and second cylinder bores 12A, 13A that are aligned in the longitudinal direction thereof. Each pair of the first and second cylinder bores 12A, 13A receives double-headed pistons 25 in a manner that the double-headed pistons 25 are reciprocable in the longitudinal direction. Specifically, the swash plate type variable displacement compressor 10 of the present embodiment is a double-headed piston type swash plate compressor. The double-headed pistons 25 correspond to the pistons of the present invention.

Each of the double-headed pistons 25 is engaged with the swash plate 23 at the outer circumference thereof through a pair of shoes 26. Rotation of the swash plate 23 caused by the rotation of the rotary shat 21 is converted into the linear reciprocating motion of the double-headed pistons 25 in the first and second cylinder bores 12A, 13A through the shoes 26. A first compression chamber 20A is defined by the double-headed pistons 25 and the first valve and port forming body 16 in each of the first cylinder bores 12A. A second compression chamber 20B is defined by the double-headed pistons 25 and the second valve and port forming body 17 in each of the second cylinder bores 13A.

The first cylinder block 12 has therein a first large-diameter hole 12B that continues from the shaft hole 12H and has a diameter larger than that of the shaft hole 12H. The first large-diameter hole 12B is in communication with the crank chamber 24. The crank chamber 24 and the suction chamber 14A communicate with each other through a suction passage 12C that is formed through the first cylinder block 12 and the first valve and port forming body 16.

The second cylinder block 13 has therein a second large-diameter hole 13B that continues from the shaft hole 13H and has a diameter larger than that of the shaft hole 13H. The second large-diameter hole 13B is in communication with the crank chamber 24. The crank chamber 24 and the suction chamber 15A communicate with each other through a suction passage 13C that is formed through the second cylinder block 13 and the second valve and port forming body 17.

The second cylinder block 13 has through the periphery thereof an inlet port 13S. The inlet port 13S is connected to the aforementioned external refrigeration circuit (not shown). The refrigerant gas that is taken from the external refrigeration circuit into the crank chamber 24 through the inlet port 13S is drawn into the suction chambers 14A, 15A through the suction passages 12C, 13C. Thus, the suction chambers 14A, 15A and the crank chamber 24 cooperate to form a suction-pressure zone of the compressor 10 and pressures in these chambers are substantially the same.

The rotary shaft 21 has an annular flange portion 21F extending radially outward from the periphery thereof in the first large-diameter hole 12B of the first cylinder block 12. A first thrust bearing 27A is disposed between the flange portion 21F of the rotary shaft 21 and the first cylinder block 12. A cylindrical support member 39 is fitted over the rear end of the rotary shaft 21. The support member 39 has an annular flange portion 39F extending radially outward from the periphery thereof in the second large-diameter hole 13B of the second cylinder block 13. A second thrust bearing 27B is disposed between the flange portion 39F of the support member 39 and the second cylinder block 13.

A fixed body 31 is fixed on the rotary shaft 21 for rotation therewith at a position that is rearward of the flange portion 21F and frontward of the swash palate 23. A movable body 32 having a bottomed cylindrical shape is mounted on the rotary shaft 21 at a position between the flange portion 21F and the fixed body 31. The movable body 32 is coupled to the swash plate 23 and movable relative to the fixed body 31 in the axial direction of the rotary shaft 21.

The movable body 32 includes an annular bottom portion 32A having therethrough an insertion hole 32E through which the rotary shaft 21 is inserted and a cylindrical portion G that extends from the outer peripheral edge of the bottom portion 32A in the axial direction of the rotary shaft 21. The inner peripheral surface of the cylindrical portion 32B is slidable relative to the outer peripheral surface of the fixed body 31. Accordingly, the movable body 32 is integrally rotatable with the rotary shaft 21 through the fixed body 31. A sealing member 33 seals between the inner peripheral surface of the cylindrical portion 32B and the outer peripheral edge of the fixed body 31 and a sealing member 34 seals between the movable body 32 and the rotary shaft 21. A control pressure chamber 35 is defined between the fixed body 31 and the movable body 32.

The rotary shaft 21 has therein a first in-shaft passage 21A that extends in the axial direction of the rotary shaft 21. The first in-shaft passage 21A is opened at the rear end thereof to the pressure regulation chamber 15C. The rotary shaft 21 further has therein a second in-shaft passage 21B that extends in the radial direction of the rotary shaft 21. The second in-shaft passage 21B is in communication at one end thereof with the tip of the first in-shaft passage 21A and is opened at the other end thereof to the control pressure chamber 35. Therefore, the control pressure chamber 35 and the pressure regulation chamber 15C are in communication with each other through the first in-shaft passage 21A and the second in-shaft passage 21B.

A lug arm 40 is disposed in the crank chamber 24 between the swash plate 23 and the flange portion 39F of the support member 39. The lug arm 40 is substantially L-shaped, having at one end thereof a weight portion 40A. The weight portion 40A extends through a groove portion 23B formed in the swash plate 23 to a position beyond the front of the swash plate 23.

One end of the lug arm 40 is connected to an upper part of the swash plate 23 (upper side in FIG. 1) by a first pin 41 that extends across the groove portion 23B. The one end of the lug arm 40 is supported rotatably relative to the swash plate 23 about a first center of rotation M1 that corresponds to the axial center of the first pin 41. The other end of the lug arm 40 is connected by a second pin 42 to the support member 39 rotatably about a second center of rotation M2 that corresponds to the axial center of the second pin 42.

The cylindrical portion 32B of the movable body 32 has at the rear end thereof a connecting portion 32C that projects toward the swash plate 23. The connecting portion 32C has therein an insertion hole 32H which is located on the movable body side and through which a third pin 43 is inserted. The swash plate 23 has in a lower part thereof (lower side in FIG. 1) an insertion hole 23H which is located on the swash plate side and through which the third pin 43 is inserted. The connecting portion 32C is connected to the lower end of the swash plate 23 through a third pin 43 inserted through the insertion holes 23H, 32H.

Pressure in the control pressure chamber 35 is controlled by introduction of refrigerant gas from the discharge chamber 15B into the control pressure chamber 35 and discharge of refrigerant gas from the control pressure chamber 35 into the suction chamber 15A. That is, the refrigerant gas to be introduced into the control pressure chamber 35 serves as the refrigerant gas that controls the pressure in the control pressure chamber. The movable body 32 is movable in the axial direction of the rotary shaft 21 relative to the fixed body 31 in response to a pressure difference between the control pressure chamber 35 and the crank chamber 24. The rear housing 15 has therein an electromagnetic displacement control valve 50 that controls pressure of the control the pressure chamber 35. The displacement control valve 50 is electrically connected to a control computer 50C. The control computer 50C is in signal connection with an air-conditioning switch 50S.

Figure 2:
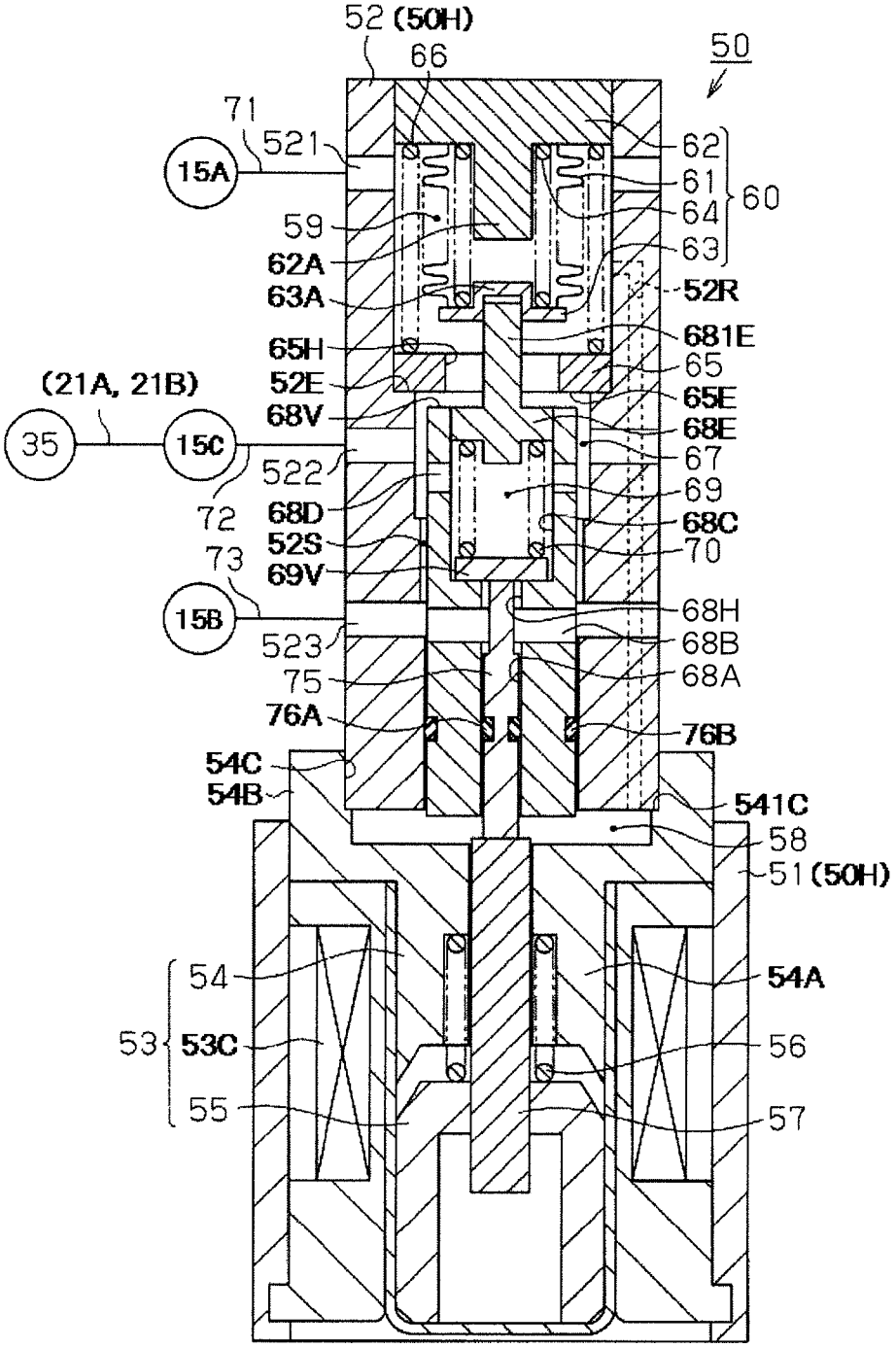
FIG. 2 is a cross-sectional view of a displacement control valve of the compressor of FIG. 1, showing a state thereof when the inclination angle of a swash plate of the compressor is minimum.

Referring to FIG. 2, the displacement control valve 50 includes a valve housing 50H. The valve housing 50H has a cylindrical first housing 51 having therein an electromagnetic solenoid 53. The electromagnetic solenoid 53 includes a coil 53C, a fixed iron core 54 and a movable iron core 55 that is attracted to the fixed iron core 54 by electromagnetic force generated when electric current is supplied to the electromagnetic solenoid 53 by an electric current supplied to the coil 53C. Electromagnetic force of the electromagnetic solenoid 53 causes the movable iron core 55 to be attracted to the fixed iron core 54. The electromagnetic solenoid 53 is duty-ratio controlled by the control computer 50C. The electromagnetic solenoid 53 further includes an urging spring 56 that is disposed between the fixed iron core 54 and the movable iron core 55 and urges the movable iron core 55 away from the fixed iron core 54.

A first transmission rod 57 is fixed to the movable iron core 55 so that the first transmission rod 57 and the movable iron core 55 are integrally movable. The fixed iron core 54 includes a small-diameter portion 54A that is located inward of the coil 53C and a large-diameter portion 54B that projects from the opening of the first housing 51 that is on the opposite side to the movable iron core 55 and has a diameter larger than the small-diameter portion 54A. One end face of the large-diameter portion 54B that is opposite to the small-diameter portion 54A has a recessed portion 54C. The inner wall of the recessed portion 54C is stepped at a stepped portion 541C. The valve housing 50H further has a cylindrical second housing 52 that is fixedly fitted in the recessed portion 54C with the bottom of the second housing 52 in contact with the stepped portion 541C.

The second housing 52 has therein an accommodating chamber 59 on the side thereof that is opposite to the electromagnetic solenoid 53. A pressure-sensitive mechanism 60 is accommodated in the accommodating chamber 59. The pressure-sensitive mechanism 60 includes a bellows 61, a pressure-receiving body 62 that is fitted in the opening of the second housing 52 on the side thereof opposite to the first housing 51 and connected to one end of the bellows 61, a connecting body 63 that is connected to the other end of the bellows 61, and a spring 64 that urges the connecting body 63 away from the pressure-receiving body 62 in the bellows 61.

The pressure-sensing body 62 has a stop portion 62A that is integrally formed with the pressure-receiving body 62 in the bellows 61. The connecting body 63 has a stop portion 63A projecting toward the stop portion 62A of the pressure-receiving body 62. The distance between the stop portion 62A of the pressure-receiving body 62 and the stop portion 63A of the connecting body 63 corresponds to the minimum length of the bellows 61.

An annular valve seat member 65 is disposed in the accommodating chamber 59 at a position opposite to the pressure-receiving body 62. An urging spring 66 is disposed between the valve seat member 65 and the pressure-receiving body 62 the accommodating chamber 59 for urging the valve seat member 65 against a stepped portion 52E formed on the inner surface of the second housing 52 to thereby position the valve seat member 65 in place. The valve seat member 65 has at the center thereof a valve hole 65H.

A back pressure chamber 58 is defined by the inner surface of the recessed portion 54C and the end surface of the second housing 52 on the side thereof that is adjacent to the electromagnetic solenoid 53. The back pressure chamber 58 and the accommodation chamber 59 communicate with each other through a communication passage 52R formed in the second housing 52.

The first transmission rod 57 extends into the back pressure chamber 58 through the fixed iron core 54. A first valve body 68V is accommodated in the second housing 52 at a position that is closer to the electromagnetic solenoid 53 than the valve seat member 65. The first valve body 68V is movable into and away from the end surface of the valve seat member 65 around the valve hole 65H thereof. Thus, the end surface of the valve seat member 65 around the valve hole 65H forms a valve seat 65E for the first valve body 68V. The valve hole 65H is closed and opened by the first valve body 68V that is movable into and away from the valve seat 65E of the valve seat member 65E. A valve chamber 67 is formed in the second housing 52 and communicable with the valve hole 65H. The first valve body 68V is accommodated in the valve chamber 67.

The first valve body 68V has on the back pressure chamber 58 side thereof a through hole 68A that extends linearly along the moving direction of the first transmission rod 57. The first valve body 68V further has a communication passage 68B that extends perpendicularly to the moving direction of the first transmission rod 57. One end of the through hole 68A on the back pressure chamber 58 side is opened to the back pressure chamber 58 and the other end of the through hole 68A is in communication with the communication passages 68B.

An accommodating recess 68C is formed in the first valve body 68V on the side thereof that is adjacent to the valve seat member 65. The opening of the accommodating recess 68C is closed by a sealing member 68E that is press-fitted in the opening of the accommodating recess 68C so that the sealing member 68E is movable with the first valve body 68V. The sealing member 68E has a projection 681E extending from one end surface of the sealing member 68E on the accommodation chamber 59 side. The projection 681E is engaged at the end thereof with the connecting body 63 of the pressure-sensitive mechanism 60 in a manner that the projection 681E is movable relative to the connecting body 63.

An accommodation chamber 69 is defined in the first valve body 68V by the accommodating recess 68C and the sealing member 68E. A connecting passage 68H is formed in the first valve body 68V at a position adjacent to the bottom of the accommodating recess 68C and provides communication between the communication passages 68B and the accommodation chamber 69. The accommodation chamber 69 has therein a second valve body 69V that opens or closes the connecting passage 68H and an urging spring 70 that is interposed between the second valve body 60V and the sealing member 68E and urges the second valve body 69V toward the bottom wall of the accommodating recess 68C. The first valve body 68V has a communication port 68D that provides communication between the accommodation chamber 69 and the valve chamber 67.

The second housing 52 has communication holes 521 that communicate with the accommodation chamber 59, communication holes 522 that communicate with the valve chamber 67, and communication holes 523 that communicate with the communication passage 68B. A clearance 52S that provides communication between the communication holes 523 and the valve chamber 67 is formed between the inner peripheral surface of the second housing 52 and the outer peripheral surface of the first valve body 68V to provide communication between the communication holes 523 and the valve chamber 67.

A second transmission rod 75 is inserted in the through hole 68A. One end of the second transmission rod 75 is in contact with the first transmission rod 57 and the other end of the second transmission rod 75 is in contact with the second valve body 69V. The movement of first and second transmission rods 57, 75 is controlled by the electromagnetic solenoid 53. Thus, the first and second rods 57, 75 form the drive force transmitting part of the present invention that changes the setting of the pressure-sensitive mechanism 60 controlling the valve opening of the first valve body 68V. A sealing member 76A is mounted on the second transmission rod 75 to seal between the communication passage 68B and the back pressure chamber 58. A sealing member 76B is mounted on the first valve body 68V to seal between the communication holes 523 and the back pressure chamber 58.

The accommodation chamber 59 communicates with the suction chamber 15A through the communication holes 521 and a passage 71. The valve chamber 67 communicates with the pressure regulation chamber 15C through the communication holes 522 and a passage 72. Thus, the second in-shaft passage 21B, the first in-shaft passage 21A, the pressure regulation chamber 15C, the passage 72, the communication holes 522, the valve chamber 67, the valve hole 65H, the accommodation chamber 59, the communication holes 521, and the passage 71 cooperate to form a bleed passage between the control pressure chamber 35 and the suction chamber 15A.

The bellows 61 expands and contracts in the direction in which the first valve body 68V moves in response to the pressure applied to the bellows 61 in the accommodation chamber 59 and the pressure applied to the first valve body 68V in the back pressure chamber 58, respectively. The expanding and contracting motion of the bellows 61 positions the first valve body 68V, thus contributing to controlling of the valve opening of the first valve body 68V. The valve opening of the first valve body 68V is determined according to the relations among the electromagnetic force generated by the electromagnetic solenoid 53, the urging force of the spring 56, and the urging force of the pressure-sensitive mechanism 60.

The first valve body 68V controls the opening of the bleed passage (or the sectional area through which air passes). When the first valve body 68V is seated on the valve seat 65E, the bleed passage is closed and the bleed passage enters the closed state, while when the first valve body 68V is separated from the valve seat 65E, the bleed passage is opened and the bleed passage enters the open state.

The discharge chamber 15B and the control pressure chamber 35 are communicable with each other through a passage 73 formed in the rear housing 15, the communication holes 523, the clearance 52S, the valve chamber 67, the communication holes 522, the passage 72, the pressure regulation chamber 15C, the first in-shaft passage 21A, and the second in-shaft passage 21B. Therefore, the passage 73, the communication holes 523, the clearance 52S, the valve chamber 67, the communication holes 522, the passage 72, the pressure regulation chamber 15C, the first in-shaft passage 21A, and the second in-shaft passage 21B cooperate to form the first supply passage between the discharge chamber 15B and the control pressure chamber 35. The opening of the first supply passage is restricted by the clearance 52S. In the present embodiment, therefore, the clearance 52S functions as a throttle provided in the first supply passage. According to the present embodiment, a part of the first supply passage is formed in the displacement control valve 50, which constitutes the displacement control mechanism that controls pressure in the control pressure chamber 35.

The discharge chamber 15B and the control pressure chamber 35 are communicable with each other through the passage 73, the communication holes 523, the communication passage 68B, the connecting passage 68H, the accommodation chamber 69, the communication port 68D, the valve chamber 67, the communication holes 522, the passage 72, the pressure regulation chamber 15C, the first in-shaft passage 21A, and the second in-shaft passage 21B. Therefore, the communication passage 68B, the connecting passage 68H, the accommodation chamber 69, and the communication port 68D cooperate to form the second supply passage that communicates with the first supply passage and provides communication between the discharge chamber 15B and the control pressure chamber 35. The first supply passage and the second supply passage are partially parallel-connected between the discharge chamber 15B and the control pressure chamber 35.

Upon receiving the urging force of the urging spring 70, the second valve body 69V is brought into contact with the bottom wall of the accommodating recess 68C, and the second supply passage is blocked and the second supply passage enters the closed state. When the second valve body 69V is separated from the accommodating recess 68C against the urging force of the urging spring 70, on the other hand, the second supply passage is opened and the second supply passage enters the open state.

The sectional area of the connecting passage 68H and the pressure-receiving area of the second transmission rod 75 that receives the pressure of refrigerant gas passing through the second supply passage are substantially the same. Therefore, the movement of the second transmission rod 75 in response to the pressure of the refrigerant gas passing through the second supply passage is prevented.

Figure 3:
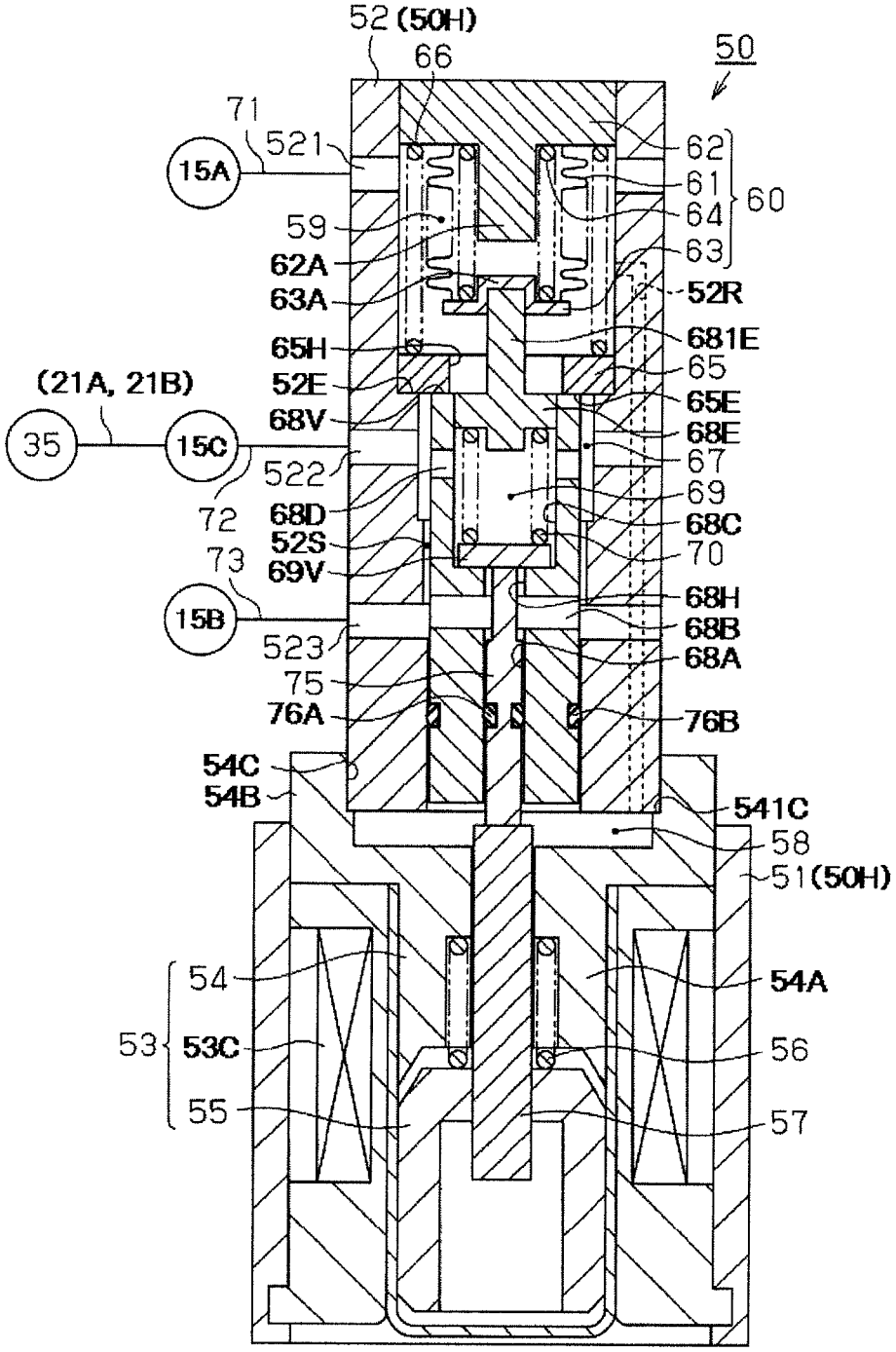
FIG. 3 is a cross-sectional view of the displacement control valve, showing a state thereof when the inclination angle of the swash plate is maximum.

When the air-conditioning switch 50S of the swash plate type variable displacement compressor 10 is turned ON and electric current is supplied to the electromagnetic solenoid 53, the electromagnetic force of the electromagnetic solenoid 53 is exerted against the urging force of the spring 56 and the movable iron core 55 is attracted to the fixed iron core 54, as shown in FIG. 3. The first transmission rod 57 presses the second valve body 69V through the second transmission rod 75. That is, the second valve body 69V is kept pressed against the bottom wall of the accommodating recess 68C by the urging force of the urging spring 70 and remains closed.

The pressing force exerted by the second transmission rod 75 on the second valve body 69V causes the first valve body 68V to move toward the valve seat member 65, which reduces the valve opening of the first valve body 68V and hence the flow of the refrigerant gas flowing from the control pressure chamber 35 to the suction chamber 15A through the second in-shaft passage 21 B, the first in-shaft passage 21A, the pressure regulation chamber 15C, the passage 72, the communication holes 522, the valve chamber 67, the valve hole 65H, the accommodation chamber 59, the communication holes 521, and the passage 71. As refrigerant gas is flowed from the discharge chamber 15B into the control pressure chamber 35 through the passage 73, the communication holes 523, the clearance 52S, the valve chamber 67, the communication holes 522, the passage 72, the pressure regulation chamber 15C, the first in-shaft passage 21A, and the second in-shaft passage 21B, the pressure in the control pressure chamber 35 is approximated to the pressure of the discharge chamber 15B.

Figure 4:
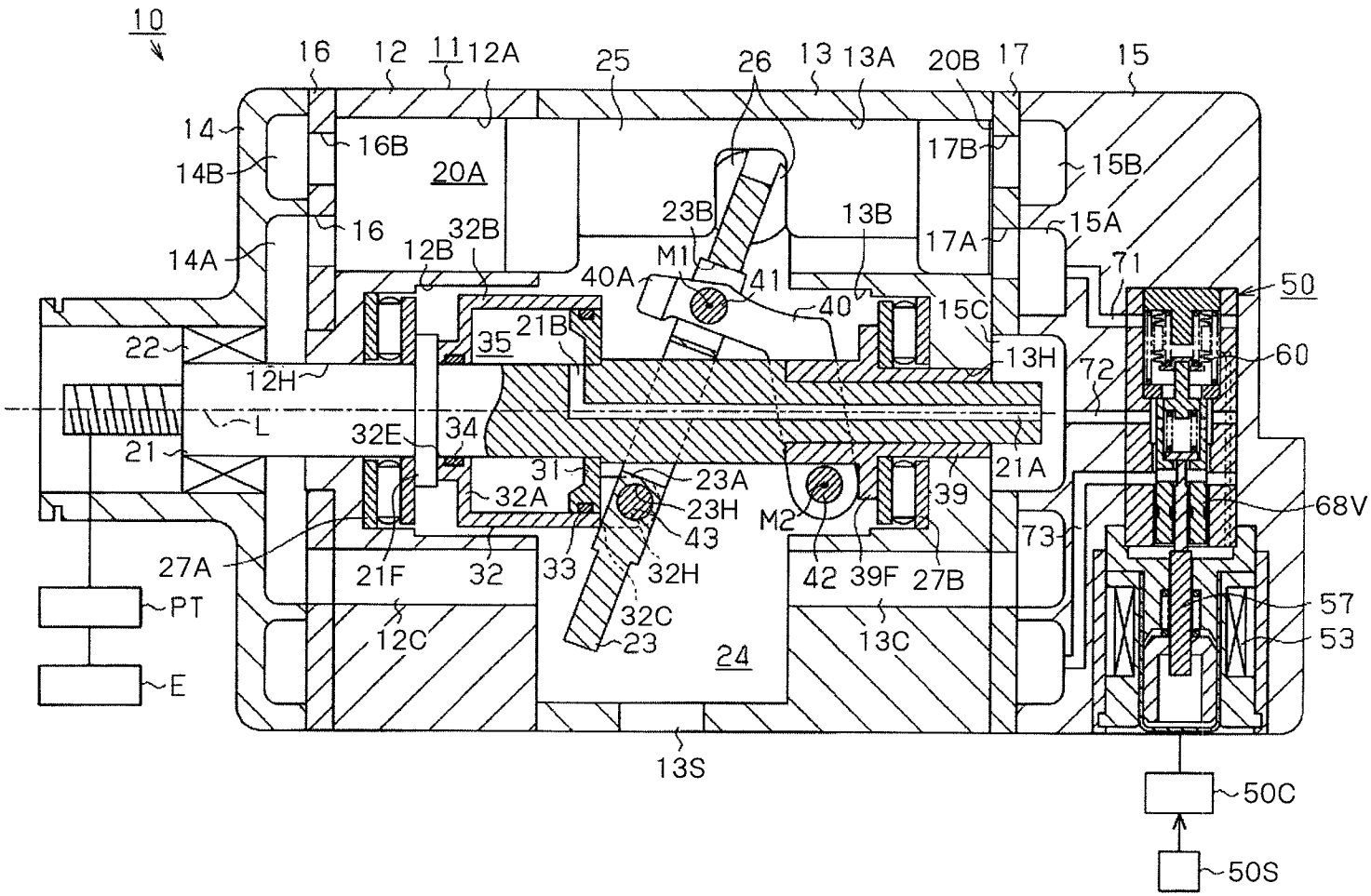
FIG. 4 is a longitudinal sectional view of the swash plate type variable displacement compressor of FIG. 1, showing a state thereof when the inclination angle of the swash plate is maximum.

As the pressure in the control pressure chamber 35 is approximated to the pressure of the discharge chamber 15B and the difference in pressure between the control pressure chamber 35 and the crank chamber 24 is increased, accordingly, the movable body 32 is moved such that its bottom portion 32A is moved away from the fixed body 31, as shown in FIG. 4. With such movement of the movable body 32, the swash plate 23 tilts about the first center of rotation M1 while rotating with the rotary shaft 21. Such tilting of the swash plate 23 about the first center of rotation M1 causes the opposite ends of the lug arm 40 to swing about the first center of rotation M1 and the second center of rotation M2, respectively, and the lug arm 40 is moved away from the flange portion 39F of the support member 39. The inclination angle of the swash plate 23 is thus increased and the stroke length of the double-headed pistons 25 is increased, accordingly, thereby increasing the displacement of the compressor 10. When the inclination angle of the swash plate 23 has reached the maximum, the movable body 32 is brought into contact with the flange portion 21F of the rotary shaft 21. The contact between the movable body 32 and the flange portion 21F maintains the swash plate 23 at the maximum inclination angle position.

As shown in FIG. 2, an increase in the valve opening of the first valve body 68V increases the flow of refrigerant gas discharged from the control pressure chamber 35 to the suction chamber 15A through the second in-shaft passage 21B, the first in-shaft passage 21A, the pressure regulation chamber 15C, the passage 72, the communication holes 522, the valve chamber 67, the valve hole 65H, the accommodation chamber 59, the communication holes 521, and the passage 71, causing the pressure in the control pressure chamber 35 to be approximated to the pressure of the suction chamber 15A.

As the pressure in the control pressure chamber 35 is approximated to the pressure of the suction chamber 15A and the difference in pressure between the control pressure chamber 35 and the crank chamber 24 is decreased, accordingly, the movable body 32 is moved such that its bottom portion 32A approaches the fixed body 31, as shown in FIG. 1. With such movement of the movable body 32, the swash plate 23 tilts about the first center of rotation M1 in the direction that decreases the inclination angle of the swash plate 23. Such tilting of the swash plate 23 in the opposite direction causes the opposite ends of the lug arm 40 to swing about the first center of rotation M1 and the second center of rotation M2, respectively, in the direction that causes the lug arm 40 to approach the flange portion 39F of the support member 39. The inclination angle of the swash plate 23 is thus decreased and the stroke length of the double-headed pistons 25 is decreased, thereby decreasing the displacement of the compressor 10. When the inclination angle of the swash plate 23 has reached the minimum, the lug arm 40 is brought into contact with the flange portion 39F of the support member 39. The contact between the lug arm 40 and the flange portion 39F maintains the swash plate 23 at the minimum inclination angle position.

The operation of the present embodiment will now be described.

Figure 5:
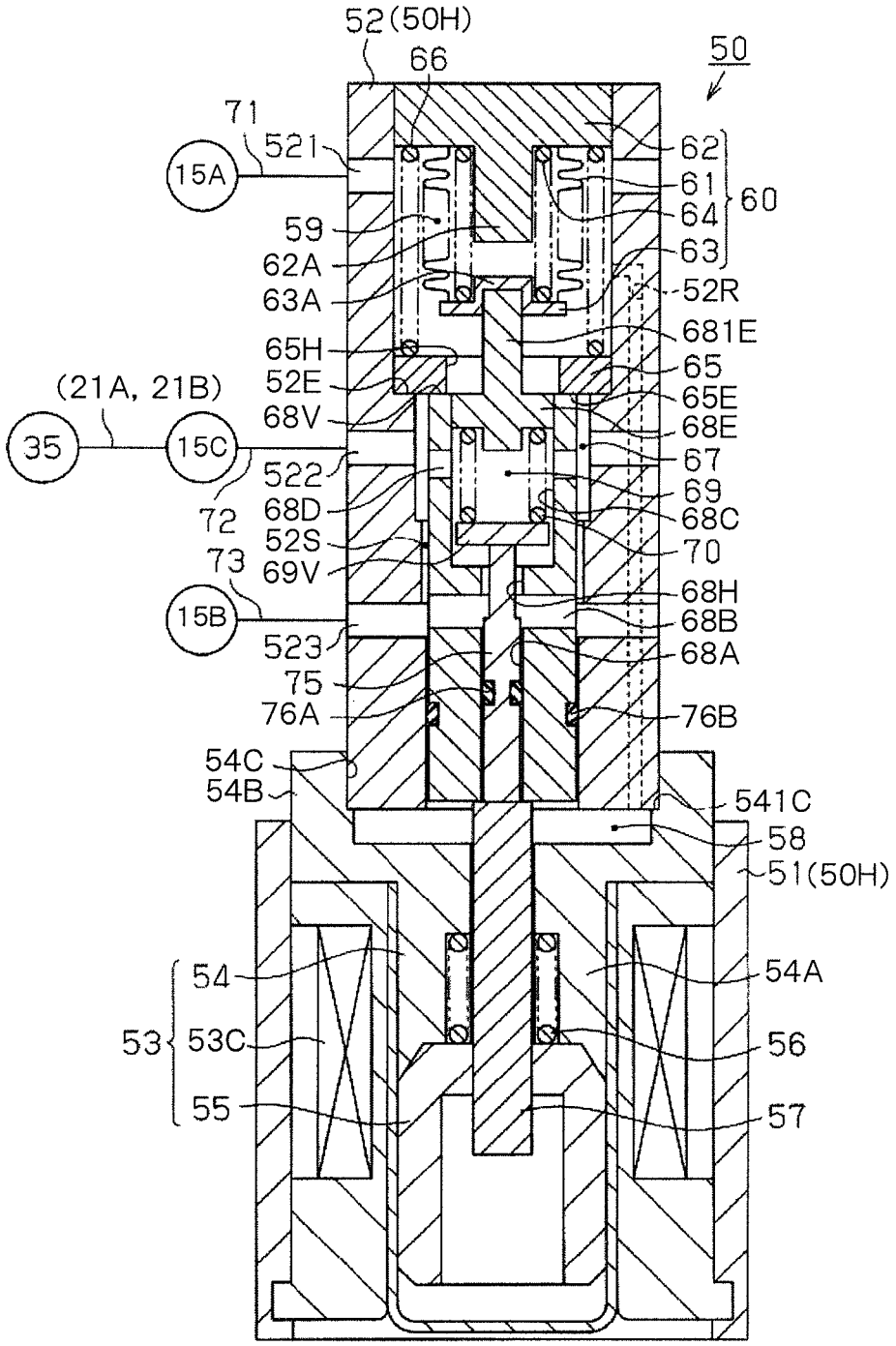
FIG. 5 is a cross-sectional view of the displacement control valve, showing a state thereof when the displacement control valve has received an instruction for operating the compressor at its maximum displacement is issued.

As shown in FIG. 5, when the air-conditioning switch 50S is turned ON, electric current is supplied to the electromagnetic solenoid 53 and the control computer 50C then issues to the displacement control valve 50 an instruction for operating the compressor 10 at the maximum displacement. Then, the electromagnetic solenoid 53 generates an electromagnetic force that attracts the movable iron core 55 to the fixed iron core 54 against the urging force of the spring 56, causing the first transmission rod 57 to push the second valve body 69V through the second transmission rod 75.

At this time the, the pressing force of the second transmission rod 75 applied to the second valve body 69V is greater than the urging force of the urging spring 70, so that the second valve body 69V under the pressing force of the second transmission rod 75 is moved away from the bottom wall of the accommodating recess 68C and opens. Specifically, the urging force of the urging spring 70 is set smaller than the pressing force applied from the second transmission rod 75 to the second valve body 69V when electric current is supplied to the electromagnetic solenoid 53 by turning ON the air-conditioning switch 50S and the control computer 50C issues to the displacement control valve 50 an instruction for operating the compressor 10 at the maximum displacement, as described above. Accordingly, part of the refrigerant gas in the discharge chamber 15B is flowed into the control pressure chamber 35 through the passage 73, the communication holes 523, the communication passage 68B, the connecting passage 68H, the accommodation chamber 69, the communication port 68D, the valve chamber 67, the communication holes 522, the passage 72, the pressure regulation chamber 15C, the first in-shaft passage 21A, and the second in-shaft passage 21B.

The pressing force applied from the second transmission rod 75 to the second valve body 69V causes the first valve body 68V to move toward the valve seat member 65, and the first valve body 68V is closed when it is seated on the valve seat 65E. In this position of the first valve body 68V, refrigerant gas in the control pressure chamber 35 is prevented from flowing to the suction chamber 15A through the second in-shaft passage 21B, the first in-shaft passage 21A, the pressure regulation camber 15C, the passage 72, the communication holes 522, the valve chamber 67, the valve hole 65H, the accommodation chamber 59, the communication holes 521, and the passage 71.

The first valve body 68V and the second valve body 69V are connected to each other through the urging spring 70 and the vale seat 65E. In controlling of the valve opening of the first valve body 68V, the drive force of the first transmission rod 57 and the second transmission rod 75 is transmitted to the first valve body 68V through the second valve body 69V. When the first valve body 68V is closed, the second valve body 69V is opened by the drive force of the first transmission rod 57 and the second transmission rod 75.

Because refrigerant gas is supplied from the discharge chamber 15B to the control pressures chamber 35 through the first supply passage, as well as from the discharge chamber 15B to the control pressure chamber 35 through the second supply passage, the pressure in the control pressure chamber 35 is approximated rapidly to a level corresponding to the pressure of the discharge chamber 15B. As a result, the swash plate 23 is tilted rapidly to its maximum inclination angle position and the compressor 10 is operated at the maximum displacement, accordingly, when electric current is supplied to the electromagnetic solenoid 53.

The following effects are achieved with the present embodiment.

(1) The displacement control valve 50 of the swash plate type variable displacement compressor 10 is configured such that when the second valve body 69V is opened, the first valve body 68V is closed, and when the second valve body 69V is closed, on the other hand, the valve opening of the first valve body 68V is controlled. With this configuration, under the circumstances where electric current is supplied to the electromagnetic solenoid 53 and an instruction for operating the compressor 10 at the maximum displacement is issued, when the first valve body 68V is closed, the second valve body 69V is opened, and refrigerant gas is supplied from the discharge chamber 15B to the control pressure chamber 35 through the second supply passage, as well as through the first supply passage. Compared with the case in which refrigerant gas is supplied from the discharge chamber 15B to the control pressure chamber 35 only through the first supply passage, the pressure in the control pressure chamber 35 may be approximated rapidly to the pressure of the discharge chamber 15B. As a result, when electric current is supplied to the electromagnetic solenoid 53, the swash plate 23 is tilted rapidly to the maximum inclination angle position for operation of the compressor 10 at the maximum displacement.

(2) The first valve body 68V has the accommodating part 69 in which the second valve body 69V is accommodated and the connecting passage 68H that is opened or closed by the second valve body 69V. With this configuration, the second valve body 69V is housed within the first valve body 68V, so that the size of the displacement control valve 50 may be made smaller as compared with the case of the second valve body 69V being disposed outside of the first valve body 68V.

(3) The sectional area of the connecting passage 68H and the pressure-receiving area of the second transmission rod 75 that receives the pressure of refrigerant gas passing through the second supply passage are substantially the same, which prevents the second transmission rod 75 from moving upon sensing the pressure of the refrigerant gas passing through the second supply passage and hence the influence of such movement of the second transmission rod 75 on the valve opening of the first valve body 68V and the second valve body 69V.

(4) The first valve body 68V and the second valve body 69V are connected to each other through the urging spring 70. In controlling of the valve opening of the first valve body 68V, the drive force of the first transmission rod 57 and the second transmission rod 75 is transmitted to the first valve body 68V through the second valve body 69V. When the first valve body 68V is closed, the second valve body 69V is opened by the drive force of the first transmission rod 57 and the second transmission rod 75. The structure in which the first valve body 68V and second valve body 69V are opened or closed by the drive force of the first transmission rod 57 and the second transmission rod 75, which simplifies the opening and closing operation of the first valve body 68V and the second valve body 69V.

(5) The clearance 52S that provides communication between the communication holes 523 and the valve chamber 67 is formed between the inner peripheral surface of the second housing 52 and the outer peripheral surface of the first valve body 68V and reduces the opening of the first supply passage. The provision of the clearance 52S makes it unnecessary to provide a restricted passage outside the displacement control valve 50 in the first supply passage, which simplifies the structure of the swash plate type variable displacement compressor 10.

(6) Unlike a swash plate type variable displacement compressor having a single-headed piston, the crank chamber 24 in the double-headed piston type swash plate compressor having the double-headed pistons 25 cannot function as the control pressure chamber for changing the inclination angle of the swash plate 23. In the swash plate type variable displacement compressor according to the present embodiment, the inclination angle of the swash plate 23 is varied by changing the pressure in the control pressure chamber 35 that is defined by the movable body 32 and the fixed body 31. Since the control pressure chamber 35 is smaller than the crank chamber 24 in volume, the amount of refrigerant gas introduced into the control pressure chamber 35 is small and changing of the inclination angle of the swash plate 23 is performed with quick response, accordingly.

The present embodiment may be modified as follows.

Figure 6:
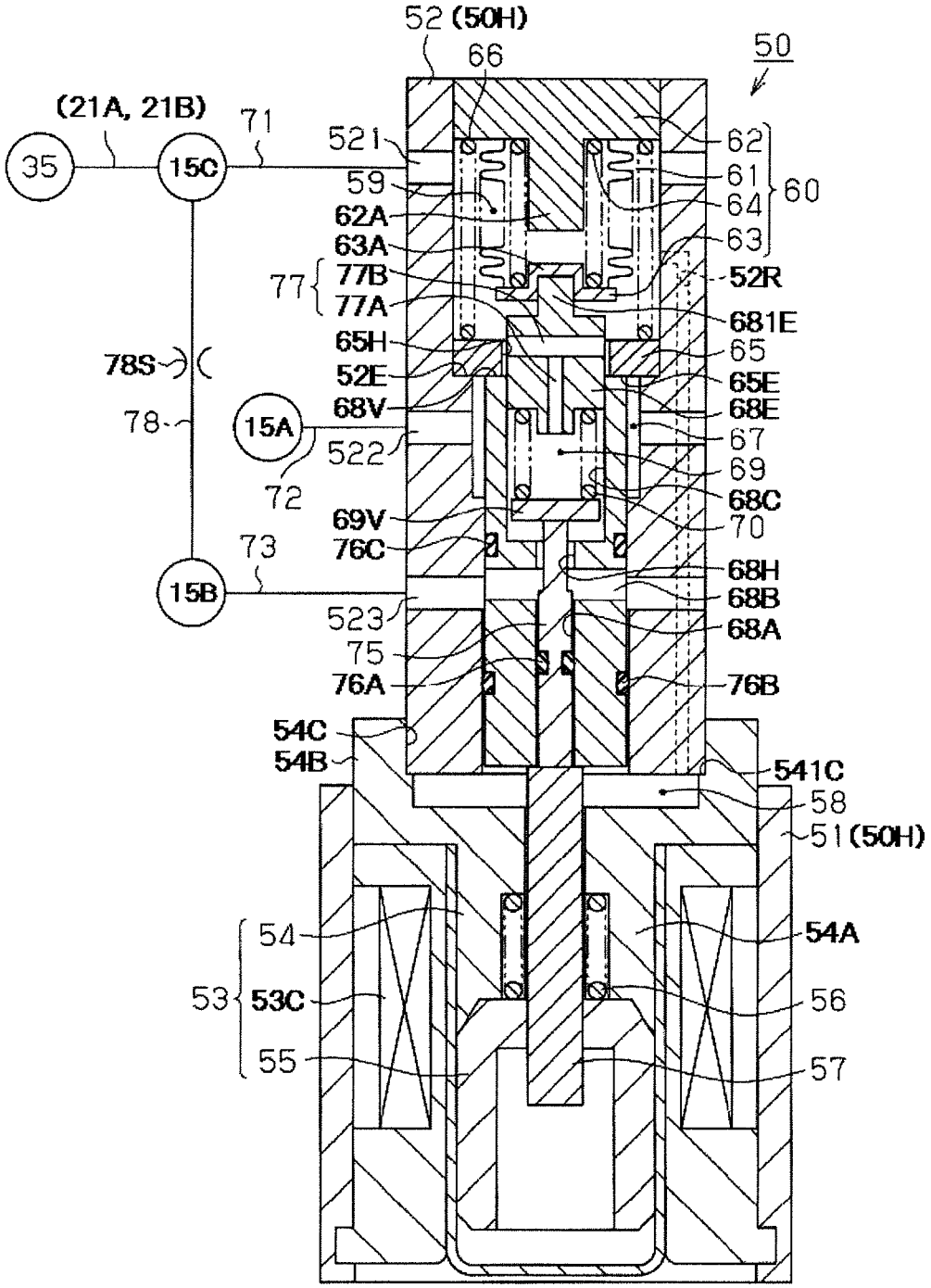
FIG. 6 is a cross-sectional view of a displacement control valve of a swash plate type variable displacement compressor according to another embodiment of the present invention.

According to the present invention, it may be so configured that the configuration may be such that the accommodation chamber 59 communicates with the pressure regulation chamber 15C through the communication holes 521 and the passage 71 and the valve chamber 67 communicates with the suction chamber 15A through the communication holes 522 and the passage 72, as shown in FIG. 6. A communication passage 77 is formed in the sealing member 68E, providing communication between the accommodation chamber 69 and the accommodation chamber 59. The communication passage 77 includes a first passage 77A that extends in the axial direction of the first valve body 68V and one end of which is opened to the accommodation chamber 69 and a second passage 77B that communicates with the first passage 77A at the other end thereof and extends perpendicularly to the first passage 77A to communicate with the accommodation chamber 59. In other words, the passage 73, the communication holes 523, the communication passage 68B, the connecting passage 68H, the accommodation chamber 69, the first passage 77A, the second passage 77B, the accommodation chamber 59, the communication holes 521, the passage 71, the pressure regulation chamber 15C, the first in-shaft passage 21A, and the second in-shaft passage 21B cooperate to form the second supply passage that provides communication between the discharge camber 15B and the control pressure chamber 35.

A communication passage 78 is formed in the swash plate type variable displacement compressor 10 outside the displacement control valve 50, providing communication between the discharge chamber 15V and the pressure regulation chamber 15C. The communication passage 78 has therein a throttle 78S. Specifically, in the embodiment of FIG. 6, the displacement control mechanism includes the displacement valve 50 and the throttle 78S. The discharge chamber 15B and the control pressure chamber 35 communicate with each other through the communication passage 78, the pressure regulation chamber 15C, the first in-shaft passage 21A, and the second in-shaft passage 21B. Therefore, the communication passage 78, the pressure regulation chamber 15C, the first in-shaft passage 21A, and the second in-shaft passage 21B cooperate to form the first supply passage between the discharge chamber 15B and the control pressure chamber 35.

The projection 681E of the sealing member 68E is fixed to the connecting body 63. In other words, the first valve body 68V is fixedly connected to the pressure-sensitive mechanism 60. The sectional area of the valve hole 65H that is opened or closed by the first valve body 68V is substantially the same as the effective pressure-receiving area of the bellows 61. Therefore, when the first valve body 68V is closed, the operation of the pressure-sensitive mechanism 60 is not influenced by the pressure in the accommodation chamber 59 and the bellows 61 expands and contract in the direction in which the first transmission rod 57 moves in response to the pressure present in the back pressure chamber 58 and acting on the first valve body 68V. A sealing member 76C is mounted on the outer peripheral surface of the first valve body 68V for sealing between the communication holes 523 and the valve chamber 67. Thus, the embodiment of FIG. 6 exhibits the effects that are substantially the same as the effects (1) to (3) and (5) of the above-mentioned embodiments.

In the present embodiment of FIG. 6, the sealing members 76A, 76B may be removed from the second transmission rod 75 and the first valve body 68V, respectively. Alternatively, sealing between the communication passage 68B and the back pressure chamber 58 may be accomplished by forming a plurality of labyrinth grooves annularly around of the second transmission rod 75. Likewise, sealing between the communication holes 523 and the back pressure chamber 58 may be accomplished by forming a plurality of labyrinth grooves annularly around the first valve body 68V.

In the present embodiment, the first transmission rod 57 and the second transmission rod 75 may be formed integrally.

In the present embodiment, the sectional area of the connecting passage 68H and the pressure-receiving are in the second transmission rod 75 that receives refrigerant gas passing through the second supply passage may be substantially the same.

In the present embodiment, the accommodation chamber 59 may communicate with the suction chamber 14A through the communication holes 521 and the passage 71. In other words, the bleed passage may be formed between the control pressure chamber 35 and the suction-pressure zone.

In the present embodiment, the discharge chamber 14B may communicate with the control pressure chamber 35 through the passage 73, the communication holes 523, the clearance 52S, the valve chamber 67, the communication holes 522, the passage 72, the pressure regulation chamber 15C, the first in-shaft passage 21A, and the second in-shaft passage 21B.

In the present embodiment, the drive force for driving the compressor 10 may be supplied from an external drive source via a clutch.

The swash plate type variable displacement compressor 10 of the foregoing embodiments is the double-headed piston type swash plate compressor. It is to be noted, however, that the present invention is applicable to a swash plate type compressor having a single-headed piston.

What is claimed is:

1. A swash plate type variable displacement compressor comprising:

a housing that includes a suction-pressure zone and a discharge-pressure zone;

a rotary shaft that is rotatably supported in the housing;

a swash plate that is disposed in the housing and is driven by the rotary shaft to rotate;

a plurality of pistons that is engaged with the swash plate;

a movable body coupled to the swash plate and adapted to change an inclination angle of the swash plate;

a control pressure chamber that is defined by the movable body and adapted to move the movable body in an axial direction of the rotary shaft when control gas drawn into the control pressure chamber changes pressure of the control pressure chamber; and a displacement control mechanism that controls pressure in the control pressure chamber, wherein the pistons are movable reciprocally with a stroke length in accordance with the inclination angle of the swash plate, a first supply passage and a second supply passage extend from the discharge-pressure zone to the control pressure chamber and are partially parallel-connected between the discharge-pressure zone and the control pressure chamber, and a bleed passage extends from the control pressure chamber to the suction-pressure zone, wherein the displacement control mechanism includes:

a throttle that is provided in the first supply passage;

a first valve body that controls an opening of the bleed passage;

a pressure-sensitive mechanism that senses pressure in the suction-pressure zone to be expanded or contracted in a moving direction of the first valve body to thereby control a valve opening of the first valve body;

an electromagnetic solenoid;

a drive force transmitting part that changes setting of the pressure-sensitive mechanism when electric current is supplied to the electromagnetic solenoid; and a second valve body that opens or closes the second supply passage by the drive force transmitting part;

when the second valve body is opened, the first valve body is closed; and when the second valve body is closed, the valve opening of the first valve body is controlled.

2. The swash plate type variable displacement compressor according to claim 1, wherein the first valve body forms a part of the second supply passage and includes an accommodation chamber in which the second valve body is accommodated and a connecting passage that is opened or closed by the second valve body.

3. The swash plate type variable displacement compressor according to claim 2, wherein a sectional area of the connecting passage and a pressure-receiving area of the drive force transmitting part that receives pressure of the control gas passing through the second supply passage are the same.

4. The swash plate type variable displacement compressor according to claim 1, wherein the first valve body and the second valve body are connected to each other through an urging member;

when the valve opening of the first valve body is controlled, drive force of the drive force transmitting part is transmitted to the first valve body through the second valve body; and when the first valve body is closed, the drive force transmitting part causes the second valve body to be opened.

5. The swash plate type variable displacement compressor according to claim 1, wherein the displacement control mechanism is a displacement control valve within which a part of the first supply passage is formed; and the throttle is formed between a valve housing of the displacement control valve and the first valve body.

6. The swash plate type variable displacement compressor according to claim 1, wherein each piston is a double-headed piston.

* * * * *